US010844701B2

(12) United States Patent
Xiao et al.

(10) Patent No.: US 10,844,701 B2
(45) Date of Patent: Nov. 24, 2020

(54) BALANCING AXIAL THRUST IN SUBMERSIBLE WELL PUMPS

(71) Applicant: Saudi Arabian Oil Company, Dhahran (SA)

(72) Inventors: Jinjiang Xiao, Dharan (SA); Chidirim Enoch Ejim, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/268,305

(22) Filed: Feb. 5, 2019

(65) Prior Publication Data

US 2020/0248538 A1 Aug. 6, 2020

(51) Int. Cl.

| | |
|---|---|
| ***E21B 43/12*** | (2006.01) |
| ***F04D 1/06*** | (2006.01) |
| ***F04D 25/06*** | (2006.01) |
| ***F04D 7/04*** | (2006.01) |
| *F04D 13/06* | (2006.01) |

(52) U.S. Cl.

CPC ..... *E21B 43/128* (2013.01); *F04D 1/06* (2013.01); *F04D 7/04* (2013.01); *F04D 25/0686* (2013.01); *F04D 13/06* (2013.01)

(58) Field of Classification Search

CPC . E21B 43/128; F04D 7/04; F04D 1/06; F04D 25/0686; F04D 13/06; F04D 13/0646; F04D 29/04; F04D 29/044

See application file for complete search history.

(56) References Cited

U.S. PATENT DOCUMENTS

| | | | |
|---|---|---|---|
| 1,912,452 | A | 6/1933 | Hollander |
| 1,978,277 | A | 10/1934 | Noble |
| 2,625,110 | A | 1/1953 | Haentjens et al. |
| 3,171,355 | A | 3/1965 | Harris et al. |
| 4,867,633 | A | 9/1989 | Gravelle |
| 5,201,848 | A | 4/1993 | Powers |

(Continued)

FOREIGN PATENT DOCUMENTS

| | | |
|---|---|---|
| CN | 2168104 | 6/1994 |
| CN | 203420906 | 2/2014 |

(Continued)

OTHER PUBLICATIONS

Godbole et al., "Paper Ref: 2977, Axial Thrust in Centrifugal Pumps—Experimental Analysis," 15th International Conference on Experimental Mechanics, Jul. 22-27, 2012, 14 pages.

(Continued)

*Primary Examiner* — David J Bagnell
*Assistant Examiner* — Yanick A Akaragwe
(74) *Attorney, Agent, or Firm* — Fish & Richardson P.C.

(57) ABSTRACT

A fluid rotor and a fluid stator. The fluid stator surrounds the fluid rotor. The fluid stator has an intake end and a discharge end. The fluid stator is shaped to be inserted into a wellbore. A shaft passes through a rotational axis of the fluid rotor. The shaft is attached to the fluid rotor to rotate in union with the fluid rotor. The shaft defines a central fluid passage that extends from the intake end of the fluid rotor to the discharge end of the fluid rotor. A balance piston surrounds the shaft. The balance piston extends from an outer surface of the shaft to an inner surface of the fluid stator. The balance piston is positioned at the intake end.

14 Claims, 7 Drawing Sheets

(56) References Cited

U.S. PATENT DOCUMENTS

| | | | | |
|---|---|---|---|---|
| 5,358,378 | A | 10/1994 | Holscher | |
| 5,620,048 | A * | 4/1997 | Beauquin | F04B 47/06 166/62 |
| 6,129,507 | A | 10/2000 | Ganelin | |
| 6,264,440 | B1 | 7/2001 | Klein et al. | |
| 7,775,763 | B1 | 8/2010 | Johnson et al. | |
| 8,013,660 | B2 | 9/2011 | Fitzi | |
| 8,016,545 | B2 | 9/2011 | Oklejas et al. | |
| 8,337,142 | B2 | 12/2012 | Eslinger et al. | |
| 8,568,081 | B2 | 10/2013 | Song et al. | |
| 9,234,529 | B2 | 1/2016 | Meuter | |
| 9,677,560 | B1 | 6/2017 | Davis et al. | |
| 2008/0187434 | A1 | 8/2008 | Neiszer | |
| 2010/0040492 | A1 | 2/2010 | Eslinger et al. | |
| 2014/0037422 | A1* | 2/2014 | Gilarranz | F04D 17/12 415/1 |
| 2017/0175752 | A1 | 6/2017 | Hofer et al. | |
| 2017/0183942 | A1 | 6/2017 | Veland | |
| 2017/0194831 | A1* | 7/2017 | Marvel | E21B 43/128 |

FOREIGN PATENT DOCUMENTS

| | | |
|---|---|---|
| CN | 104533797 | 4/2015 |
| EP | 3527830 | 8/2019 |
| GB | 670206 | 4/1952 |
| WO | 9927256 | 6/1999 |
| WO | 2011133620 | 10/2011 |
| WO | 2016160016 | 10/2016 |

OTHER PUBLICATIONS

Sulzer Technical Review, "Pushing the Boundaries of Centrifugal Pump Design," Oil and Gas, Jan. 2014, 2 pages.

International Search Report and Written Opinion issued in International Application No. PCT/US2020/016507 dated May 25, 2020, 6 pages.

International Search Report and Written Opinion issued in International Application No. PCT/US2020/016494 dated May 20, 2020, 15 pages.

* cited by examiner

BALANCING AXIAL THRUST IN SUBMERSIBLE WELL PUMPS

TECHNICAL FIELD

This disclosure relates to well pumps.

BACKGROUND

Natural resources, such as oil, natural gas or underground water, are trapped in underground reservoirs beneath a surface of the Earth. Wells are drilled to recover the trapped natural resources. In some instances, the reservoir fluids flow to the surface due to differential pressure between the reservoir and surface. In other instances, an artificial lift is needed to recover the trapped natural resources. Artificial lift methods, such as well pumps, are frequently used in the production or injection of fluids in hydrocarbon or water wells.

One type of well pumps is electrical submersible pumps (ESP), powered by an electric motor. An ESP is lowered into a well and operates beneath the surface of the reservoir fluid and includes, mainly, a centrifugal pump, motor, and protector (also known as seal chamber section or seal section). In a standard ESP configuration, the centrifugal pump generates axial thrust during operation. The axial thrust load is absorbed primarily by thrust bearings in the protector.

SUMMARY

This disclosure describes technologies relating to balancing axial thrusts in submersible well pumps.

An example implementation of the subject matter described within this disclosure is a downhole-type pump with the following features. A fluid rotor. A fluid stator that surrounds the fluid rotor. The fluid stator has an intake end and a discharge end. The fluid stator is shaped to be inserted into a wellbore. A shaft passes through a rotational axis of the fluid rotor. The shaft is attached to the fluid rotor to rotate in union with the fluid rotor. The shaft defines a central fluid passage that extends from the intake end of the fluid rotor to the discharge end of the fluid rotor. A balance piston surrounds the shaft. The balance piston extends from an outer surface of the shaft to an inner surface of the fluid stator. The balance piston is positioned at the intake end.

Aspects of the example downhole-type pump, which can be combined with the example downhole-type pump alone or in combination, include the following. The balance piston includes dynamic seals around an outer circumference of the balance piston. The dynamic seals are positioned between the balance piston and the fluid stator.

Aspects of the example downhole-type pump, which can be combined with the example downhole-type pump alone or in combination, include the following. The balance piston is attached to the shaft to rotate in unison with the shaft.

Aspects of the example downhole-type pump, which can be combined with the example downhole-type pump alone or in combination, include the following. The fluid rotor is a centrifugal fluid rotor and the fluid stator is a centrifugal fluid diffuser.

Aspects of the example downhole-type pump, which can be combined with the example downhole-type pump alone or in combination, include the following. A portion of a magnetic coupling is positioned at the intake end of the rotor.

Aspects of the example downhole-type pump, which can be combined with the example downhole-type pump alone or in combination, include the following. A thrust bearing axially supports the fluid rotor within the stator. The thrust bearing is housed within a housing that is attached to the fluid stator.

Aspects of the example downhole-type pump, which can be combined with the example downhole-type pump alone or in combination, include the following. The thrust bearing is sized based on a net axial thrust load of the fluid rotor during operation. The net axial thrust load includes a sum of a first thrust created by displacing a fluid, a second thrust created by a portion of the displaced fluid pressurizing the balance piston, and a third thrust created by a weight of the fluid rotor.

Certain aspects of the subject matter described here can be implemented as a method. A fluid rotor, which is positioned within a wellbore, is rotated. A fluid is pressurized and displaced in response to rotating the fluid rotor. A first axial thrust is created in response to the pressurized and displaced fluid. A portion of the pressurized and displaced fluid is directed to an opposite side of the rotor. A second axial thrust, which is created by the portion of the pressurized and displaced fluid, counters the first axial thrust.

Aspects of the example method, which can be combined with the example method alone or in combination, include the following. The second axial thrust counters the first axial thrust by creating a pressure chamber, which is pressurized. The pressure chamber is defined by a fluid stator and a balance piston. The balance piston axially attaches to the fluid rotor. The balance piston has sufficient surface area to counteract the first axial thrust a desired amount. The balance piston is positioned at an end of the fluid rotor opposite of where the first axial thrust is applied.

Aspects of the example method, which can be combined with the example method alone or in combination, include the following. The fluid includes wellbore production fluid.

Aspects of the example method, which can be combined with the example method alone or in combination, include the following. The fluid rotor is rotated by a magnetic coupling that transfers rotary motion to the fluid rotor.

Aspects of the example method, which can be combined with the example method alone or in combination, include the following. A thrust bearing axially supports the fluid rotor. The thrust bearing is positioned within a housing. The housing surrounds the rotor.

An example implementation of the subject matter described within this disclosure is a system with the following features. The system includes a downhole-type pump. The downhole-type pump includes a fluid rotor that has an intake end and a discharge end. The downhole-type pump includes a fluid stator that surrounds the fluid rotor. The fluid stator has an intake end and a discharge end. The discharge end of the fluid stator corresponds with the discharge end of the fluid rotor and the intake end corresponds with the intake end of the fluid rotor. The downhole-type pump includes a shaft that passes through the center of the fluid rotor. The shaft is attached to rotate in union with the fluid rotor. The shaft defines a central fluid passage that extends from the intake end of the fluid rotor to the discharge end of the fluid rotor. The downhole-type pump includes a balance piston that surrounds the shaft. The balance piston extends from an outer surface of the shaft to an inner surface of the fluid stator. The balance is positioned on the intake end of the rotor. The system includes a production string that fluidically connects a discharge end of the downhole-type pump to a topside facility. The system includes a motor that is rotatably coupled to the fluid rotor. The motor is connected to the fluid rotor by a coupling.

Aspects of the example system, which can be combined with the example system alone or in combination, include the following. The motor is positioned downhole of the pump.

Aspects of the example system, which can be combined with the example system alone or in combination, include the following. The coupling includes a magnetic coupling.

Aspects of the example system, which can be combined with the example system alone or in combination, include the following. The motor includes a first thrust bearing and the pump includes a second thrust bearing that is separate from the first thrust bearing.

Aspects of the example system, which can be combined with the example system alone or in combination, include the following. The balance piston includes dynamic seals around an outer circumference of the balance piston. The dynamic seals are positioned between the balance piston and the fluid stator.

Aspects of the example system, which can be combined with the example system alone or in combination, include the following. The balance piston is attached to the shaft to rotate in unison with the shaft.

Aspects of the example system, which can be combined with the example system alone or in combination, include the following. The fluid rotor is a centrifugal fluid rotor and the fluid stator is a centrifugal fluid diffuser.

Particular implementations of the subject matter described in this disclosure can be implemented so as to realize one or more of the following advantages. The axial thrust balancing methods of this disclosure eliminate or reduce, axial thrusts generated in submersible well pumps. The methods of this disclosure do not sacrifice the pump's volumetric efficiency. In instances where the downhole-type pump of this disclosure uses a magnetic coupling instead of a protector or seal section, the amount of equipment needed to operate the ESP is reduced and, thus, the failure rate is decreased. The protector section removal eliminates the mechanical contact between the motor and pump shaft. As a result, the motor is fully encapsulated and sealed from contacting the production fluid, which, in effect, eliminates a common reason for motor failure in ESPs. Because of the protector removal, the overall length of the ESP system is shortened. Thus, the shorter ESP system leads to easier field installation in shallow wellbores.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure relates to balancing axial thrust in submersible well pumps with forces induced from one or more pump's discharge pressure. In some instances, a protector or seal section in an electrical submersible pump (ESP) is replaced with a magnetic coupling to improve the ESP's reliability and reduce failure rate in parts like the protector section. Consequently, the burden for handling the pump's axial thrust is shifted from thrust bearings in the protector and motor to the pump itself.

To balance the axial thrust, several methods have been introduced in this disclosure. In one implementation, a hollow shaft is used to route some of the pressurized fluid from the pump discharge to the bottom of the pump. A balance piston positioned at a downhole end of the pump is used to counteract the pump's downward axial thrust resulting from the discharge pressure. In other implementations, different back-to-back pressure gaining section configurations are used to counter the axial thrust of the other section. The subject matter described herein can be applied to production or injection wells.

Figure 1:
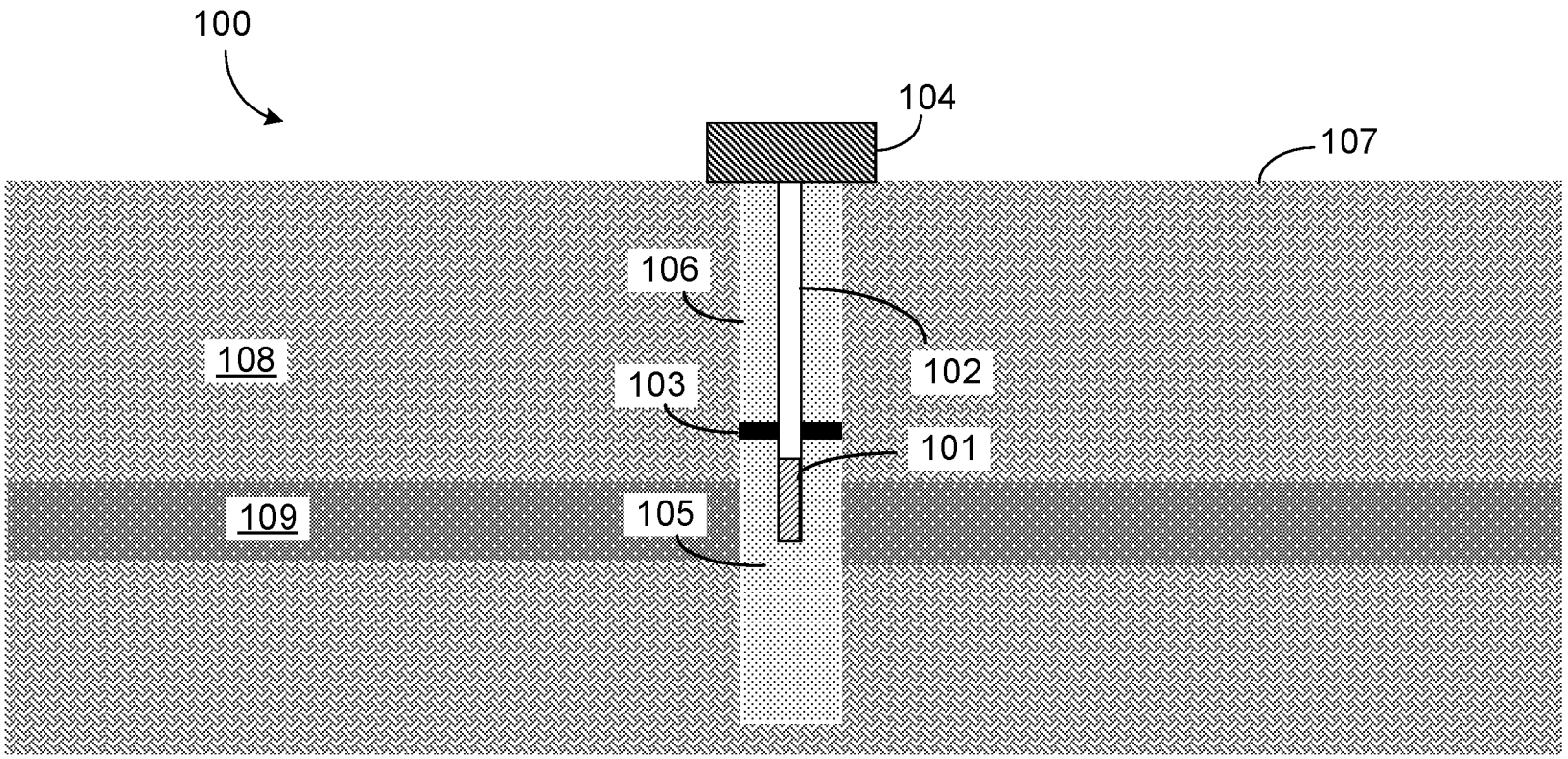
FIG. 1 is a schematic diagram of an example well system with an example submersible pump system.

FIG. 1 is a schematic of an example well 100 with an example electrical submersible pump (ESP) system 101. The well 100 extends from surface 107 into the Earth 108. The well 100 is shown as a vertical well, but in other instances, the well 100 can be a deviated well with a wellbore 106 deviated from vertical (for example, horizontal or slanted). The wellbore 106 of the well 100 is typically, although not necessarily, cylindrical. The wellbore 106 is a drilled hole or an openhole portion of the well 100 that extends from the surface 107 into a production zone 109. The production zone 109 (also known as a pay zone) is a reservoir or a part of a reservoir that include entrapped hydrocarbons (for example, oil, gas, combinations of them or other hydrocarbons).

The well 100 includes a tubular 102 that is connected to a discharge end of the ESP system 101. In some implementations, the tubular 102 is a production string positioned within the wellbore 106 and used to produce a production fluid 105. The production fluid 105 can include hydrocarbons, water, or both. The tubular 102 is made of materials compatible with the wellbore geometry, production requirements, and well fluids. The tubular 102 can be suspended from a topside facility 104. The topside facility 104 is the upper part of a structure, above the surface 107, that includes hydrocarbon processing facilities. The topside facility 104 can include one or more of the following modules: hydrocarbon treatment, hydrocarbon storage, and utility systems or drilling facilities.

The well 100 includes an ESP system 101. The ESP system 101 is used to lift the production fluid 105 from the production zone 109 to the surface 107. As described earlier, the ESP system 101 is connected to a downhole end of the tubular 102. The ESP system 101 is positioned within the wellbore 106 at a depth where the ESP system 101 is to be operated to raise the production fluid 105 to the surface 107. In some implementations, the ESP system 101 includes a centrifugal pump. In some implementations, the ESP system 101 includes a progressive cavity pump. In some implementations, the pump in the ESP system 101 includes one or more stages. Each stage adds kinetic energy to the fluid 105 and converts the energy into pressure head. Pressure head or "head" is the height of a liquid column that a pump can produce against gravity. The head generated by each individual stage is summative; hence, the total head developed by a multi-stage ESP system 101 increases linearly from the first to the last stage.

ESPs can be of floater, modular, or compression design. In some implementations, the ESP system 101 has floater stage design. In floater stages, impellers are not fixed to a shaft. As such, impellers can have limited axial movement on the shaft between diffusers. Typically, axial thrust created by the ESP moves impellers in a downward direction. At high flow rates, impellers can move in an upward direction. To handle the axial thrust in either direction, synthetic washers are mounted to each impeller's lower and upper surface. These washers transfer the axial thrust load from impellers to diffusers. The diffusers transfer the axial thrust to the pump housing. Floater design is preferred when the thrust load cannot be handled by a single thrust bearing in the protector section. In some implementations, the ESP system 101 has modular stage design. Similar to the floater design, impellers are not fixed to the shaft in the modular design. Unlike the floater design, the modular design uses bearings to support upward and downward axial thrust instead of washers. In some implementations, the ESP system 101 has compression stage design (can also be referred to as "fixed impeller" pumps). In the compression design, impellers can be longitudinally fixed or locked to a shaft. Therefore, axial thrust created by impellers is transferred via the shaft to the thrust bearings in the protector and motor. Compression pumps allow a wider operating range as downward axial thrust washers are not used. The pump design features previously described are applicable to all different implementations described hereinafter.

In some implementations, a packer 103 is positioned uphole of the ESP system 101. The packer 103 is a downhole-type device that fluidically isolates the portion of the wellbore 106 (or, if the wellbore is cased, the portion of the casing) uphole of the packer 103 from the portion downhole of the packer 103. In some implementations, the packer 103 seals the annulus defined by the inner surface of the wellbore 106 (or, if cased, the inner surface of the casing) and an outer surface of the tubular 102. By sealing the annulus, the packer 103 can direct flow towards the ESP system 101, which can enable controlled production or injection. In some implementations, the packer 103 includes an opening through which cables, hydraulic lines, or both (for example, power cables or cables carrying other information) can be passed to the ESP system 101.

Figure 2:
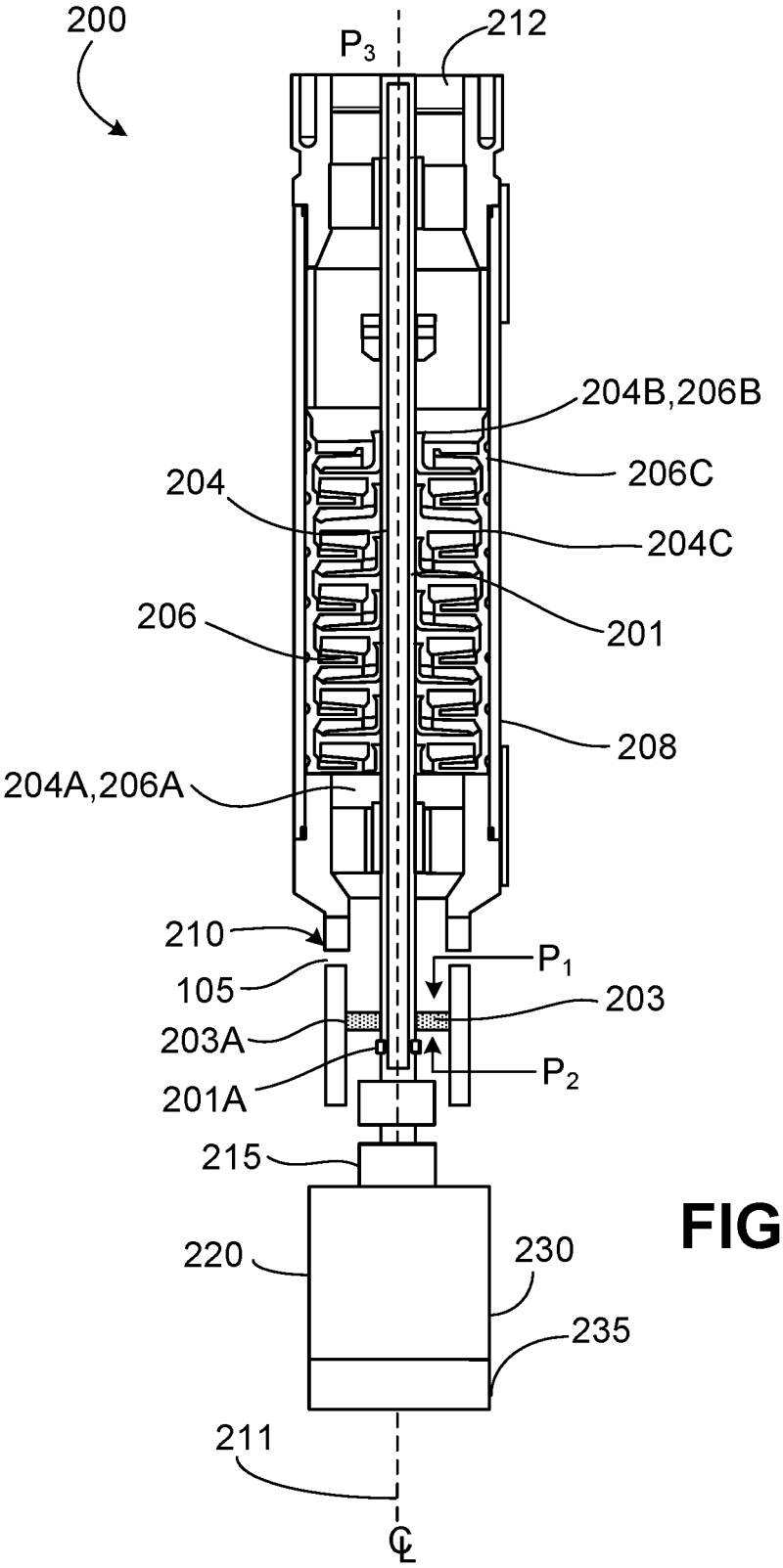
FIG. 2 is a side cross-sectional diagram of an example submersible pump with a balance piston.

FIG. 2 shows a side cross-sectional diagram of an example electrical submersible pump (ESP) 200. In some implementations, the ESP system 101 of FIG. 1 includes an ESP 200 (can also be referred to as pump 200) and an ESP motor 230 that is operatively coupled to the ESP 200 in order to drive the ESP 200. The ESP 200 is used to lift the production fluid 105 flowing from an ESP intake 210 to the surface 107 (FIG. 1). In some implementations, the ESP intake 210 is positioned near the middle of the ESP 200 while an ESP discharge 212 is at an uphole end of the ESP 200. In some implementations, the ESP intake 210 is at a downhole end of the ESP 200. In some implementations, the ESP discharge 212 is at a downhole end of the ESP 200. As described earlier, the ESP 200 can include one or more stages.

The ESP 200 includes a fluid rotor 204. The fluid rotor 204 has an intake end 204A and a discharge end 204B. The fluid rotor 204 is configured to rotate around a rotational axis 211 passing through the center of the intake end 204A and the discharge end 204B. The intake end 204A can be located at a downhole end of the ESP 200. The discharge end 204B can be located at an uphole end of the ESP 200. The discharge end 204B is fluidically connected to the tubular 102 (FIG. 1).

The fluid rotor 204 includes a shaft 201. The shaft 201 is a hollow shaft that passes through a central rotational axis 211 of the fluid rotor 204. The shaft 201 is attached to the fluid rotor 204 and configured to rotate in unison with the fluid rotor 204. The shaft 201 is hollow and, thus, defines a central fluid passage that extends from the intake end 204A of the fluid rotor 204 to the discharge end 204B of the fluid rotor 204. The shaft 201 directs a portion of a pressurized production fluid 105 pumped by the ESP 200 from the pump discharge 212 to a shaft opening 201A downhole of the pump intake 210. The shaft opening 201A provides an outlet to the portion of the production fluid 105 that is pressurized and displaced from the pump discharge 212 through the central fluid passage of the shaft 201. In some implementations, the shaft opening 201A is located downhole the pump intake 210.

The fluid rotor 204 includes a piston 203. The piston 203 is a balance piston that surrounds the shaft 201. The piston 203 is positioned downhole of the pump intake 210 and uphole of the shaft opening 201A. The balance piston 203 extends from an outer surface of the shaft 201 to an inner surface of a housing 208. A pressure differential is created across the piston 203. The piston 203 fluidically isolates an uphole section pressurized by flow from the pump intake 210 and a downhole section pressurized by flow from the shaft opening 201A. As a result, the piston 203 counters a downward axial thrust created by the pump discharge 212 with an upward axial thrust created by the directed pressurized fluid 105 routed by the hollow shaft 201. In some implementations, the piston 203 can be a diaphragm. In some implementations, the balance piston 203 is attached to the shaft 201 to rotate in unison with the shaft 201. Because the piston 203 is attached to the shaft 201, the upward axial thrust acting on the piston 203 creates an upward lifting force that counters the combination of the downward axial thrust and a weight of the rotor 204. In some implementations, the piston 203 is configured to not rotate with the shaft 201 so long as the uplifting force due to the differential pressure uphole and downhole the piston 203 is transferred to the shaft 201 through any force transfer mechanism. The diameter of the piston 203 is calculated to create sufficient uplifting force to counteract the combination of the downward axial thrust and the weight of the rotor 204.

In some implementations, the piston 203 can have a keyed or threaded bore to accept the shaft 201. In some implementations, the piston 203 can be attached to the shaft 201 through an interference fit, friction fit, or any other fastening method. In some implementations, the piston 203 includes dynamic seals 203A around an outer circumference of the piston 203. The dynamic seals 203A seals an annulus defined by the outer surface of the piston 203 and the inner surface of the housing 208 to prevent the pressurized fluid 105 flowing directly from the shaft opening 201A and bypassing the piston 203. Such a bypass would reduce the pressure differential that causes the lifting force countering the downward axial thrust. In some implementations, the dynamic seals 203A includes a metal-to-metal seal. In some implementations, the dynamic seals 203A can include elastomer O-rings. In some implementations, the dynamic seals 203A can include any other dynamic seal that prevents the fluid 105 from bypassing the piston 203.

The fluid rotor 204 includes one or more impellers 204C. The impeller 204C is a rotating component of the fluid rotor 204 which adds rotational energy from an ESP motor 230, which drives the ESP 200, to the production fluid 105 being pumped. The fluid rotor 204 accelerates the fluid 105 outwards from the center of the axis of rotation 211 of the fluid rotor 204. The impeller 204C can include vanes or blades that direct the fluid 105 outwards from the center of the rotational axis 211. The impeller 204C is attached to the shaft 201 to rotate in unison with the shaft 201. In some implementations, the impeller 204C can have a keyed or threaded bore to accept the shaft 201. In some implementations, the impeller 204C can be attached to the shaft 201 through an interference fit, friction fit, or any other fastening method. The fluid rotor 204 is made from materials robust enough to withstand the contact, pressure, and chemical harshness of the production fluid 105. In some implementations, the fluid rotor 204 is a centrifugal fluid rotor.

The ESP 200 includes a fluid stator 206. The fluid stator 206 surrounds the fluid rotor 204 and has an intake end 206A and a discharge end 206B. The intake end 206A of the fluid stator 206 corresponds with the intake end 204A of the fluid rotor 204 and the discharge end 206B of the fluid stator 206 corresponds with the discharge end 204B of the fluid rotor 204. The fluid stator 206 includes one or more diffusers 206C. The diffuser 206C is a stationary component of the fluid stator 206 that converts rotational energy, supplied by the impeller 204C to the production fluid 105, into pressure head. The diffuser 206C can include vanes that controls the flow of the fluid 105 from the intake end 206A to the discharge end 206B. The stator 206 is configured in shape and size to be inserted into the wellbore 106 (FIG. 1). The stator 206 is made from materials robust enough to withstand the impact from installation and chemical harshness of the production fluid 105. In some implementations, the fluid stator 206 is a centrifugal fluid stator. In some implementations, a volute can be used to direct the fluid 105 flow from the fluid rotor 204 in lieu or in addition to a diffuser.

The ESP 200 includes a housing 208. The housing 208 is a pump casing that surrounds the ESP 200, including the fluid stator 206. The housing can extend from the pump discharge 212 and the tubular 102 (FIG. 1), on one end, to a coupling 220, on another end. The fluid stator 206 is fixedly attached to the housing 208 with anti-rotation devices to prevent the diffusers 206C from rotating with the fluid rotor 204. In some implementations, the housing 208 includes (and houses) a thrust bearing 215. The thrust bearing 215 axially supports the fluid rotor 204 within the fluid stator 206. The thrust bearing 215 can be positioned downhole of the piston 203. The thrust bearing 215 can be sized based on a net axial thrust load of the fluid rotor 204 during operation. The net axial thrust load includes a sum of a first thrust created by the pump discharge 212, a second thrust created by the portion of the displace fluid pressurizing the balance piston 203, and a third thrust created by a weight of the fluid rotor 204. In some implementations, a thrust bearing is not needed because the axial thrust is mitigated by the axial thrust balancing methods described herein.

The ESP system 101 of FIG. 1 includes a coupling 220. The coupling 220 rotatably couples an ESP motor 230 to the fluid rotor 204 of the ESP 200. The coupling 220 transmits torque generated by the ESP motor 230 to the ESP 200, which causes the fluid rotor 204 to rotate in response. In some implementations, the coupling 220 is a magnetic coupling. The magnetic coupling 220 is a coupling that transmits torque without physical or mechanical contact using magnets or magnetic field. The magnetic coupling 220 allows the ESP motor 230 to be fully encapsulated and isolated from the production fluid 105 due to the elimination of the mechanical contact between the ESP motor 230 and the ESP 200. In some implementations, the magnetic coupling 220 is an axial gap magnetic coupling. The axial gap magnetic coupling transmits torque (and not axial thrust) from the ESP motor 230 to the ESP 200. In some implementations, the magnetic coupling 220 is a radial gap magnetic coupling. The radial gap magnetic coupling can transfer axial thrust between the ESP motor 230 and the ESP 200 and, thus, an additional thrust bearing can be used to support the ESP 200. In some implementations, the coupling 220 is positioned at a downhole end of the ESP 200. The coupling 220 can be sized and clearances can be set to account for thermal expansion of components of the ESP system 101 (FIG. 1), such as the shaft 201, during operation.

The ESP system 101 of FIG. 1 includes an ESP motor 230. The ESP motor 230 converts electrical energy into mechanical energy in the form of rotation. As described earlier, the ESP motor 230 drives the ESP 200 by rotating the fluid rotor 204. In some implementations, the ESP motor 230 is positioned downhole of the ESP 200. The ESP motor 230 includes a thrust bearing 235. The thrust bearing 235 is housed within the ESP motor 230. In some implementations, the thrust bearing 235 is positioned at an uphole end of the motor 230. In some implementations, the thrust bearing 235 is positioned at a downhole end of the motor 230. The thrust bearing 235 is sized to axially support a weight of the ESP motor 230 shaft. In some implementations, the thrust bearing 235 is sized to axially support the fluid rotor 204 and the ESP motor 230 shaft.

Figure 3:
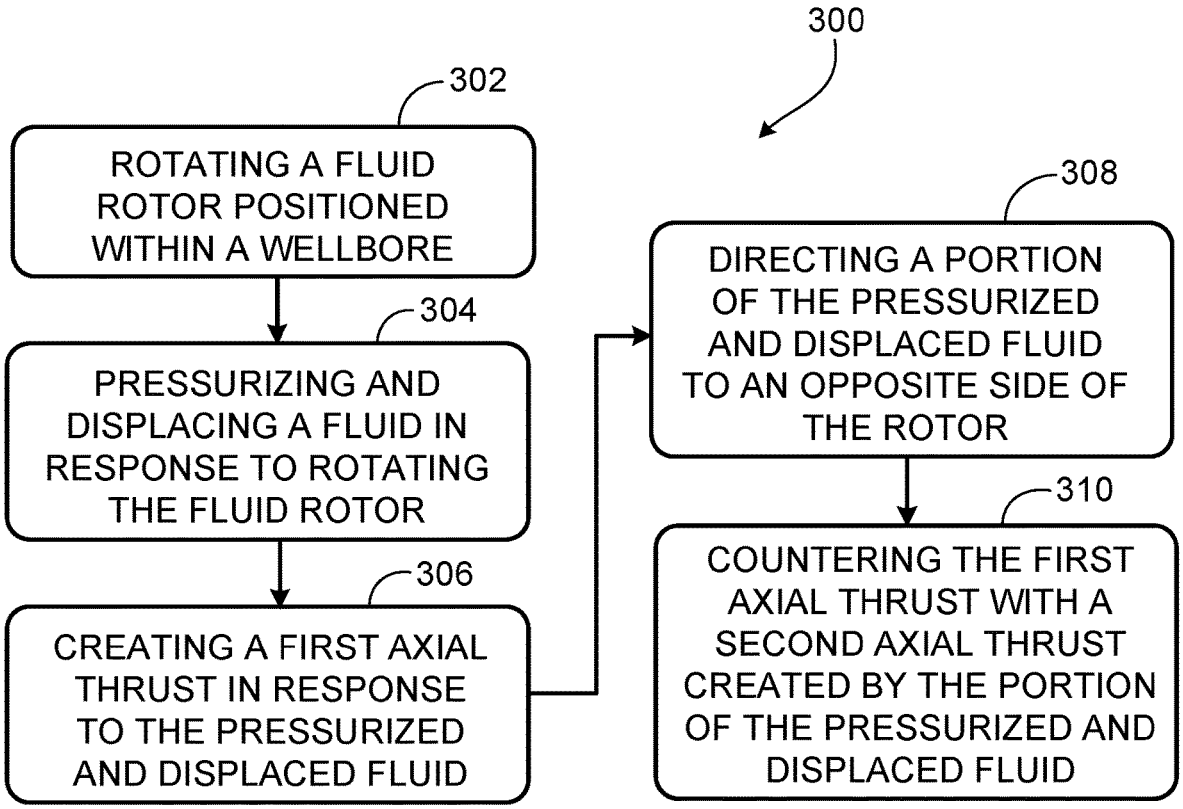
FIG. 3 is a flowchart of an example thrust balancing method using a balance piston that can be used with aspects of this disclosure.

FIG. 3 shows a flowchart of an example method 300 of how an example ESP 200 of FIG. 2 works. Details of the method 300 are described in the context of FIGS. 1-2. At 302, upon starting an ESP system 101 positioned within a wellbore 106, an ESP motor 230 rotates a fluid rotor 204 of the ESP 200. In some implementations, a magnetic coupling 220 is used to transfer the rotary motion from the ESP motor 230 to the fluid rotor 204 to rotate the ESP 200. In some implementations, the fluid rotor 204 is axially supported by a thrust bearing 215 positioned within a housing 208. The housing 208 surrounds a fluid stator 206 and fluid rotor 204.

At 304, the ESP 200 pressurizes and displaces a fluid 105 in response to the rotary motion transferred to the fluid rotor 204. The fluid rotor 204 converts the rotary motion transferred from the ESP motor 230 into rotational energy applied to the fluid 105. The rotational or kinetic energy is due to the rotation of one or more impellers 204C attached to the rotor 204. The fluid stator 206 includes one or more diffusers 206C that convert the rotational energy of the fluid 105 into pressure head. The pressurized fluid 105 is displaced through a discharge end 206B of the stator 206 onto the pump discharge 212. In some implementations, the fluid 105 is a wellbore production fluid. The wellbore production fluid can include oil, gas, water, or a combination of some or all.

At 306, the pressurized and displaced fluid 105 creates a first axial thrust in the ESP 200. In some implementations, the first axial thrust is a force acting downwards in reaction to a pressure differential developed by the ESP 200. The pressure differential is a result of a lower pressure fluid 105 entering the pump intake 210 and a higher pressure fluid 105 exiting the pump discharge 212. In some implementations, because the pump discharge 212 is located at an uphole end of the pump intake 210, the first axial thrust's direction is downwards towards the lower pressure pump intake 210.

At 308, before the fluid 105 is discharged via the pump discharge 212 to the tubular 102, a portion of the pressurized and displaced fluid 105 is directed to an opposite end of the rotor 204. Once the portion of the pressurized fluid 105 is displaced, little or no flow is further directed through the hollow shaft 201 to the opposite end of the rotor 204 so long as the dynamic seals 203A continue to prevent the fluid 105 from bypassing the piston 203. As a result, the ESP 200 pumping efficiency is not affected, and pressure communication is established along the hollow shaft 201 between the two ends of the rotor 204. The portion of the pressurized production fluid 105 is directed from the pump discharge 212 downhole of a balance piston 203. In some implementations, the piston 203 is positioned downhole of the pump intake 210. In some implementations, the piston 203 is positioned at an end of the rotor 204 opposite of the pump discharge 212. In some implementations, the balance piston 203 is uphole of the coupling 220. In some implementations, the balance piston 203 is uphole of the thrust bearing 215.

At 310, the first axial thrust is countered with a second axial thrust. The second axial thrust is created by the portion of the pressurized and displaced fluid 105 pressurizing a pressure chamber downhole of the piston 203. The pressure chamber is defined by an outer surface of the piston 203 and an inner wall of the housing 208. The pressure acting on the piston 203 can be expressed as pump discharge 212 pressure plus hydrostatic pressure between the pump discharge 212 and the piston 203. In some implementations, the second axial thrust acts upward on the piston 203 to counter the downward axial thrust created by the pump discharge 212. The second axial thrust's direction is upward due to the differential pressure between the pressure chamber downhole of the piston 203 and the lower pump intake 210 pressure uphole of the piston 203.

In some implementations, the piston 203 is axially attached to the fluid rotor 204. In some implementations, the piston 203 rotates with the rotor 204. The piston 203 has a sufficient surface area to counteract the first axial thrust and a third axial thrust. The third axial thrust is created by a weight of the fluid rotor 204. In some implementations, the thrust bearing 215 is sized based on a net axial thrust load of the fluid rotor during operation. The net axial thrust load comprising a sum of the first thrust created by displacing the fluid 105, the second thrust created by a portion of the displace fluid 105 pressurizing the balance piston 203, and the third thrust created by the weight of the fluid rotor 204.

Figure 4A:
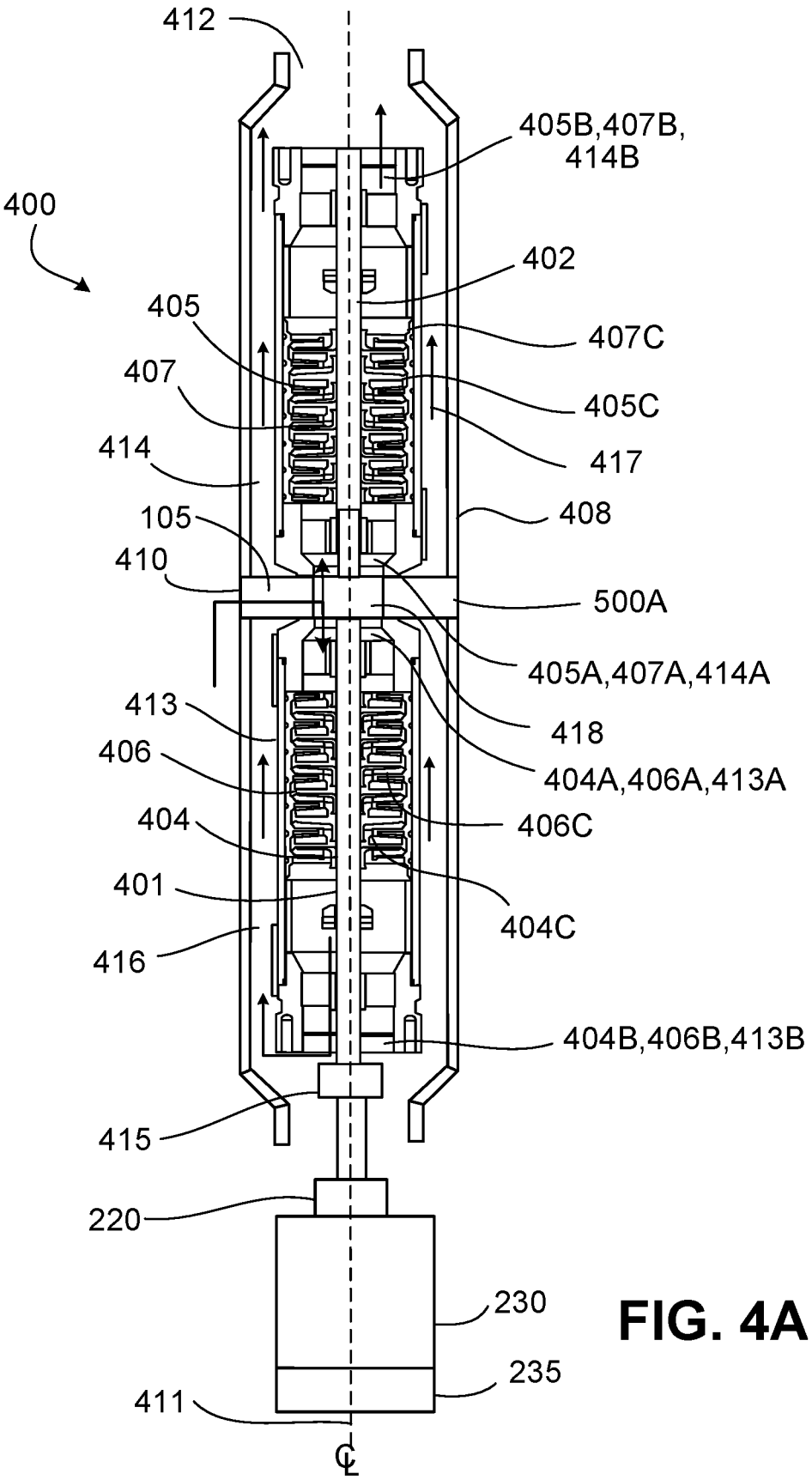
FIG. 4A-4B are cross-sectional diagrams of example submersible pumps with back-to-back arrangements between stages.
Figure 4B:
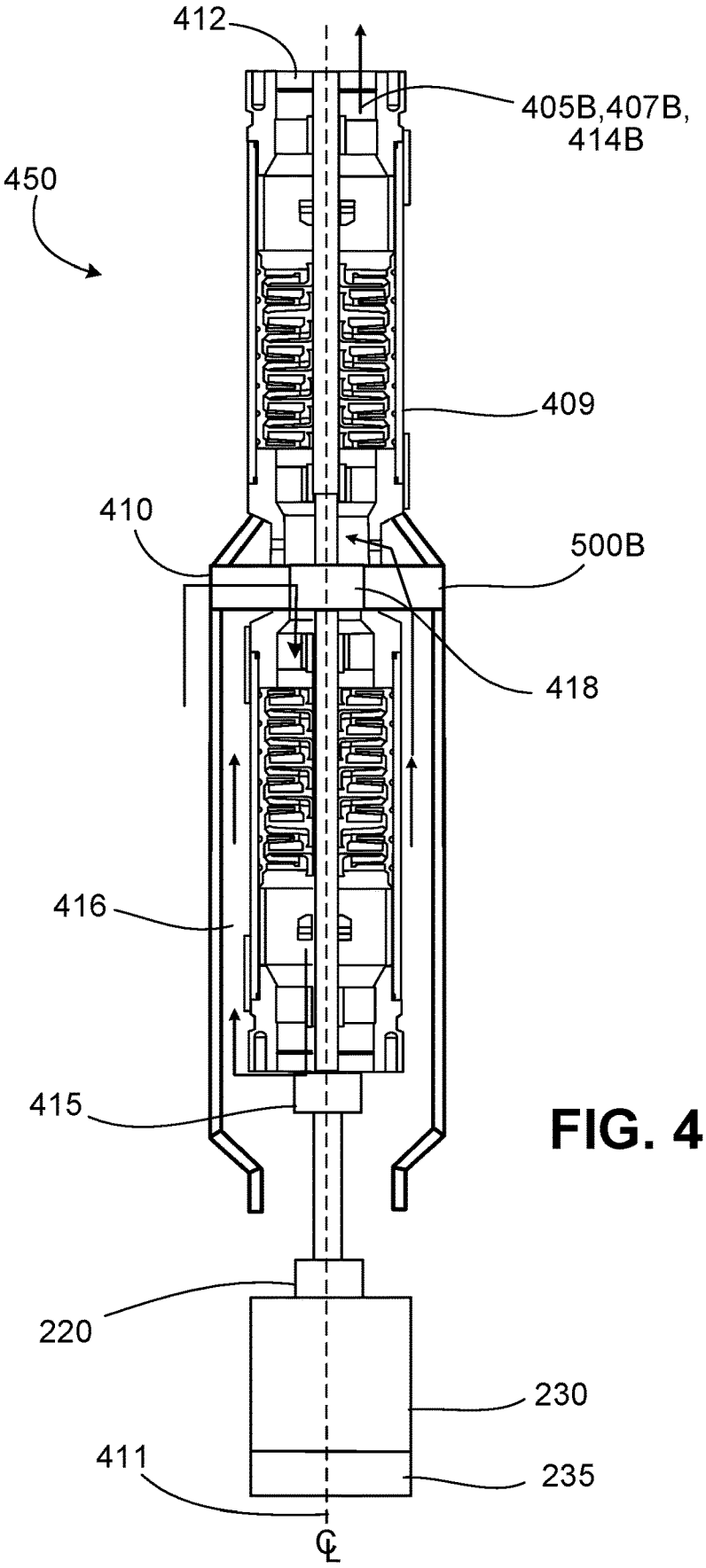

Other implementations are illustrated by FIGS. 4A-4B. FIG. 4A shows a schematic cross-sectional diagram of an example submersible pump 400. In some implementations, the ESP system 101 of FIG. 1 includes an ESP 400 that is characterized by an in-parallel flow arrangement between back-to-back pressure gaining sections. As described earlier, the ESP system 101 is used to lift the production fluid 105 flowing from an ESP intake 410 through an ESP discharge 412 to the surface 107 (FIG. 1). In some implementations, the ESP intake 410 is positioned at a mid-point of the ESP 400 while the ESP discharge 412 is at an uphole end of the ESP 400. The discharge end 412 is fluidically connected to the tubular 102 (FIG. 1). The ESP 400 can include two or more stages.

The ESP 400 includes a first fluid rotor 404. The first fluid rotor 404 has a first fluid intake end 404A and a first fluid discharge end 404B. The first fluid rotor 404 is configured to rotate around a rotational axis 411 passing through the center of the intake end 404A and the discharge end 404B. The intake end 404A can be located at an uphole end of the ESP 400. The discharge end 404B can be located at a downhole end of the ESP 400.

The first fluid rotor 404 includes a first shaft 401 and a first impeller 404C. The first shaft 401 passes through a central rotational axis 411 of the fluid rotor 404. The shaft 401 is attached to the fluid rotor 404 and configured to rotate in unison with the fluid rotor 404. The first fluid rotor 404 can include one or more impellers 404C. The first impeller 404C is a rotating component of the fluid rotor 404 which adds rotational energy from an ESP motor 230, which drives the ESP 400, to the production fluid 105 being pumped by accelerating the fluid 105 outwards from the center of the fluid rotor 404 rotation. The impeller 404C can include vanes or blades that direct the fluid 105 from the intake end 404A to the discharge end 404B. The impeller 404C is attached to the shaft 401 to rotate in unison with the shaft 401. In some implementations, the impeller 404C can have a keyed or threaded bore to accept the shaft 401. In some implementations, the impeller 404C can be attached to the shaft 401 through an interference fit, friction fit, or any other fastening method. The fluid rotor 404 is made from materials robust enough to withstand the impact and chemical harshness of the production fluid 105. In some implementations, the fluid rotor 404 is a centrifugal fluid rotor.

The ESP 400 includes a second fluid rotor 405. The second fluid rotor 405 is rotatably coupled to the first fluid rotor 404 to rotate in unison with the first fluid rotor 404 along a shared rotational axis 411. The second fluid rotor 405 has a second fluid intake end 405A and a second fluid discharge end 405B. The second fluid rotor 405 is configured to rotate around a rotational axis 411 passing through the center of the intake end 405A and the discharge end 405B. The intake end 405A can be located at a downhole end of the ESP 400 while the discharge end 405B can be located at an uphole end of the ESP 400.

In some implementations, the first fluid intake end 404A and the second fluid intake end 405A are facing opposite directions. In some implementations, the first fluid discharge end 404B and the second fluid discharge end 405B are facing opposite directions. In some implementations, the first fluid intake end 404A is at an uphole end of the first fluid rotor 404 while the second fluid intake end 405A is at a downhole end of the second fluid rotor 405. In some implementations, the first fluid intake end 404A is at a downhole end of the first fluid rotor 404 while the second fluid intake end 405A is at an uphole end of the second fluid rotor 405. In some implementations, the first fluid discharge end 404B is at a downhole end of the first fluid rotor 404 while the second fluid discharge end 405B is at an uphole end of the second fluid rotor 405. In some implementations, the first fluid discharge end 404B is at an uphole end of the first fluid rotor 404 while the second fluid discharge end 405B is at a downhole end of the second fluid rotor 405.

Like the first fluid rotor 404, the second fluid rotor 405 includes a second shaft 402 and a second impeller 405C. The second shaft 402 and second impeller 405C are similar in construction and function to the first shaft 401 and the first impeller 404C, respectively. In some implementations, the second shaft 402 and the first shaft 401 can be one shaft (that is, the first fluid rotor 404 and the second fluid rotor 405 share the same shaft). In some implementations, the second shaft 402 can be rotatably coupled to the first shaft 401 by a coupling 418. The coupling 418 can be a magnetic coupling. In some implementations, the coupling 418 is positioned between the first fluid rotor 404 and second fluid rotor 405. The coupling 418 can be sized, and clearances (for example, a gap between the first shaft 401 and the second shaft 402, and a gap between impellers and diffusers) can be set to account for thermal expansion of components of ESP 400, such as the first shaft 401 and the second shaft 402, during operation. The second fluid rotor 405 is made from materials same or similar to the first fluid rotor 404. In some implementations, the second rotor 405 is a centrifugal fluid rotor.

The ESP 400 includes a first fluid stator 406. The first fluid stator 406 surrounds the first fluid rotor 404. The first fluid stator 406 is aligned along the rotational axis 411 of the first fluid rotor 404. The first fluid stator 406 has an intake end 406A and a discharge end 406B. The intake end 406A of the first fluid stator 406 corresponds with the intake end 404A of the first fluid rotor 404 and the discharge end 406B of the first fluid stator 406 corresponds with the discharge end 404B of the first fluid rotor 404. The fluid stator 406 has a first diffuser 406C. In some implementations, the first diffuser 406C includes one or more diffusers. The first diffuser 40C is fixedly attached to first fluid stator 406 with anti-rotating devices to prevent the diffuser 406C from rotating with the first fluid rotor 404. The first diffuser 406C is a stationary component of the fluid stator 406 that converts rotational energy, supplied by the first impeller 404C to the production fluid 105, into pressure head. The diffuser 406C can include vanes that controls the flow of the fluid 105 from the intake end 406A to the discharge end 406B. The stator 406 is configured in shape and size to be inserted into the wellbore 106 (FIG. 1). The stator 406 is made from materials robust enough to withstand the impact and chemical harshness of the production fluid 105. In some implementations, the first fluid stator 406 is a centrifugal fluid stator or diffuser. In some implementations, a volute can be used to direct the fluid 105 flow from the first fluid rotor 404 in lieu or in addition to a diffuser.

The first fluid rotor 404 and first fluid stator 406 form a first fluid stage 413. The first fluid stage 413 has a first fluid intake 413A and a first fluid discharge 413B. The first fluid intake 413A can correspond with the first fluid intake 404A of the first fluid rotor 404 and the first fluid intake 406A of the first fluid stator 406. The first fluid discharge 413B can correspond with the first fluid discharge 404B of the first fluid rotor 404 and the first fluid discharge 406B of the first fluid stator 406. In some implementations, the first fluid discharge 413B is at a downhole end of the first fluid stage 413 while the first fluid intake 413A is at an uphole end of the first fluid stage 413.

The ESP 400 includes a second fluid stator 407. The second fluid stator 407 surrounds the second fluid rotor 405 and is aligned along the rotational axis 411 of the second fluid rotor 405. The second fluid stator 407 has an intake end 407A and a discharge end 407B. The intake end 407A of the second fluid stator 407 corresponds with the intake end 405A of the second fluid rotor 405 and the discharge end 407B of the second fluid stator 407 corresponds with the discharge end 405B of the second fluid rotor 405. The fluid stator 407 has a second diffuser 407C. In some implementations, the second diffuser 407C includes one or more diffusers. The second diffuser 407C is similar in construction and function to the first diffuser 406C. In some implementations, a volute can be used to direct the fluid 105 flow from the second fluid rotor 405. The second fluid stator 407 is made from materials same or similar to the first fluid stator 406 and configured in size to be inserted into the wellbore 106 (FIG. 1). In some implementations, the second fluid stator 407 is a centrifugal fluid stator or diffuser.

The second fluid rotor 405 and second fluid stator 407 form a second fluid stage 414. The second fluid stage 414 has a second fluid intake 414A and a second fluid discharge 414B. The second fluid intake 414A can correspond with the second fluid intake 405A of the second fluid rotor 405 and the second fluid intake 407A of the second fluid stator 407. The second fluid discharge 414B can correspond with the second fluid discharge 405B of the second fluid rotor 405 and the second fluid discharge 407B of the second fluid stator 407. In some implementations, the second fluid discharge 414B is at an uphole end of the second fluid stage 414 while the second fluid intake 414A is at a downhole end of the second fluid stage 414.

The ESP 400 includes a flow crossover sub 500A. The flow crossover sub 500A is positioned between the first fluid stage 413 and the second fluid stage 414. The flow crossover sub 500A is a stationary device that can surround a shaft and can define multiple ports and holes to distribute flow. The crossover sub 500A can be machined from a solid metal stock. In some implementations, the crossover sub 500A surrounds the first shaft 401. In some implementations, the crossover sub 500A surrounds the second shaft 402. In some implementations, the crossover sub 500A surrounds the coupling 418 that rotatably couples the first shaft 401 with the second shaft 402. The flow arrangement between the two pressure gaining sections (first fluid stage 413 and second fluid stage 414) described herein are all in-parallel. The flow crossover sub 500A defines flow passages that fluidically connect the first fluid stage 413 and the second fluid stage 414. In some implementations, the crossover sub 500A accepts flow from the ESP intake 410. Subsequently, the crossover sub 500A directs flow to the intake 413A of the first fluid stage 413 and the intake 414A of the second fluid stage 414 simultaneously. The flow crossover sub 500A is configured in shape and size to be inserted in the ESP 400 and is made from materials robust enough to withstand the downhole conditions of the ESP 400. In some implementations, the flow from the ESP intake 410 is divided substantially equally in the crossover sub 500A between the first fluid intake 413A and the second fluid intake 414A because the first fluid stage 413 is substantially identical to the second fluid stage 414.

The ESP 400 includes an outer housing 408. The outer housing 408 surrounds the first fluid stator 406, the second fluid stator 407 and the flow crossover sub 500A. The housing 408 can extend from the tubular 102 (FIG. 1), on one end, to a coupling 220, on the other end. An inner surface of the housing 408 abuts an outer surface of the flow crossover sub 500A to create a fluid seal. The crossover sub 500A can be fixedly attached to the outer housing 408 with anti-rotating devices to prevent the crossover sub 500A from rotating with the ESP 400. The flow arrangement between the two pressure gaining sections (first fluid stage 413 and second fluid stage 414) described herein are all in-parallel. The housing 408 and the first fluid stator 406 define a first flow passage 416 that fluidically connects the ESP intake 410 to the intake 413A of the first fluid stage 413 and the intake 414A of the second fluid stage 414. In some implementations, the first flow passage 416 fluidically connects the ESP discharge 412 to the discharge 413B of the first fluid stage 413 and the discharge 414B of the second fluid stage 414. In some implementations, the housing 408 and the second fluid stator 407 define a second flow passage 417. In some implementations, the flow crossover sub 500A fluidically connects the first flow passage 416 with the second flow passage 417. The fluid 105 flows from the discharge end 413B of the first fluid stage 413 through the first flow passage 416, the flow crossover sub 500A, and the second flow passage 417. In some implementations, the fluid 105 discharged from the first fluid stage 413 fluidically connects with the fluid 105 discharged from the second fluid stage 414 to be routed to the ESP discharge 412.

The housing 408 includes a thrust bearing 415. The thrust bearing 415 axially supports the first fluid rotor 404 within the first fluid stator 406. The thrust bearing 415 can be housed in a downhole end of the housing 408. The thrust bearing 415 can be sized based on a net axial thrust load of the first fluid rotor 404 and the second fluid rotor 405 during operation. The net axial thrust load includes a sum of a first thrust created by the first fluid stage 413, a second thrust created by the second fluid stage 414, a third thrust created by a weight of the first fluid rotor 404, and a fourth thrust created by a weight of the second fluid rotor 405.

In some implementations, the ESP motor 230 is rotatably coupled to the first fluid rotor 404 by a coupling 220. In some implementations, the ESP motor 230 is rotatably coupled to the second fluid rotor 405 by a coupling 220. In some implementations, the ESP motor 230 is positioned downhole of the ESP 400. In some implementations, the coupling 220 can be a magnetic coupling.

FIG. 4B includes a similar back-to-back configuration as FIG. 4A, but has the following differences described herein. FIG. 4B shows a schematic cross-sectional diagram of an example submersible pump 450. In some implementations, the ESP system 101 of FIG. 1 includes an ESP 450 that is characterized by an in-series flow arrangement between back-to-back pressure gaining sections (a first fluid stage 413 and a second fluid stage 414). Like the ESP 400, the ESP 450 is used to lift the production fluid 105 through the tubular 102 to the surface 107 (FIG. 1). The ESP 450 can include two or more stages.

The ESP 450 includes a flow crossover sub 500B. The flow crossover sub 500B is positioned between the first fluid stage 413 and the second fluid stage 414. The flow arrangement between the two pressure gaining sections (first fluid stage 413 and second fluid stage 414) described herein are all in-series. The flow crossover sub 500B defines flow passages that fluidically connect the first fluid stage 413 and the second fluid stage 414. In some implementations, the crossover sub 500B accepts flow from the ESP intake 410. Subsequently, the crossover sub 500B directs flow to the intake 413A of the first fluid stage 413. In some implementations, the crossover sub 500B defines a fluid passage that fluidically connects the discharge 413B of the first fluid stage 413 and the intake 414A of the second fluid stage 414. Unlike the crossover sub 500A in ESP 400 of FIG. 4A, which directs flow to the first stage 413 and second stage 414 simultaneously, the crossover sub 500B in ESP 450 directs flow to the second stage 414 after the first stage 413.

The ESP 450 includes an outer housing 409. The outer housing 409 surrounds the first fluid stator 406, the second fluid stator 407 and the flow crossover sub 500B. The second fluid stator 407 in ESP 450 (unlike the second fluid stator 407 in ESP 400 of FIG. 4A) is fixedly attached to the housing 409 to prevent flow from bypassing the second fluid stage 414. Unlike ESP 400 of FIG. 4A, which includes a discharge end 414B of the second stage 414 that is different than the pump discharge 412, the pump discharge 412 in ESP 450 is the same as the discharge 414B of the second stage 414. The housing 409 can extend from the tubular 102 (FIG. 1), on one end, to a coupling 220, on the other end. An inner surface of the housing 409 abuts an outer surface of the flow crossover sub 500B to create a fluid seal. The flow arrangement between the two pressure gaining sections (first fluid stage 413 and second fluid stage 414) described herein are all in-series. The housing 409 and the first fluid stator 406 define a first flow passage 416 that fluidically connects the ESP intake 410 to the intake 413A of the first fluid stage 413 and the intake 414A of the second fluid stage 414. In some implementations, the first flow passage 416 fluidically connects the discharge 413B of the first fluid stage 413 and the intake 414A of the second fluid stage 414. The discharge 414B of the second fluid stage 414 fluidically connects to the ESP discharge 412. The fluid 105 flows through the first flow passage 416 and the second fluid stage 414 to the ESP discharge 412.

In some implementations, the first fluid stage 413 and the second fluid stage 414 share a common fluid discharge. The discharge end 413B can be uphole the first fluid stage 413 while the discharge end 414B can be downhole the second fluid stage 414. The outer housing 408 and the first fluid stator 406 define a first flow passage 416 fluidically connecting the common fluid discharge to the discharge 413B of the first fluid stage 413 and the discharge 414B of the second fluid stage 414.

In some implementations, the first fluid stage 413 and the second fluid stage 414 share a common fluid intake. The intake end 413A can be uphole the first fluid stage 413 while the intake end 414A can be downhole the second fluid stage 414.

Figure 5A:
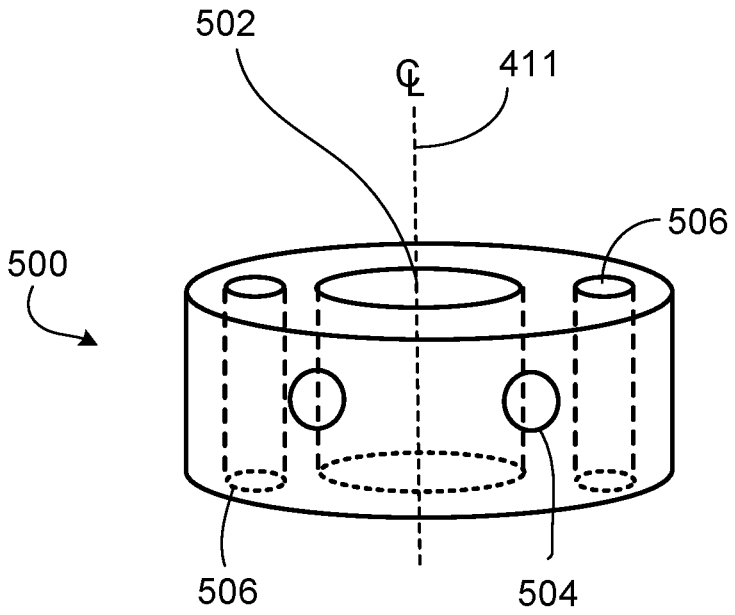
FIG. 5A is a three-dimensional view diagram of an example crossover sub that can be used with aspects of this disclosure.
Figure 5B:
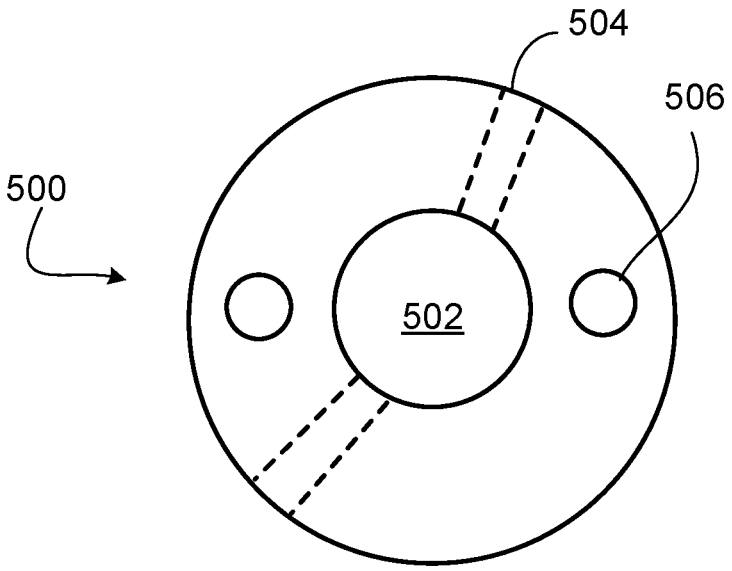
FIG. 5B is a top view diagram of an example crossover sub that can be used with aspects of this disclosure.

FIGS. 5A-5B show different views of an example flow crossover sub 500. The flow crossover sub 500 can be used as the flow crossover sub 500A or the flow crossover sub 500B. The crossover sub 500 includes a shaft bore 502. The shaft bore 502 is a bore that can surround a shaft and can allow the shaft to rotate freely around a rotational axis 411. The shaft bore 502 is fluidically connected to an intake flow port 504. In some implementations, the intake flow port 504 includes one or more flow ports. The intake flow port 504 is aligned to accept flow from the ESP intake 410. The shaft bore 502 defines a flow passage that fluidically connects the intake flow port 504 to the first fluid stage 413 (FIGS. 4A-4B). In some implementations, the shaft bore 502 defines a flow passage that fluidically connects the intake flow port 504 to the second fluid stage 414 (FIG. 4A).

The flow crossover sub 500 includes a discharge flow port 506, as illustrated by FIGS. 5A-5B. In some implementations, the discharge flow port 506 includes one or more flow ports. The discharge flow port 506 is aligned to accept flow from the discharge end 413B of the first fluid stage 413 (FIGS. 4A-4B). In some implementations, the discharge flow port 506 fluidically connects the first flow passage 416 with the second flow passage 417 (FIG. 4A). In some implementations, the discharge flow port 506 fluidically connects the first flow passage 416 with the intake end 414A of the second fluid stage 414 (FIG. 4B). In some implementations, the discharge flow port 506 defines a flow passage that fluidically connects the intake end 413A of the first fluid stage 413 with the intake end 414A of the second fluid stage 414.

Figure 6:
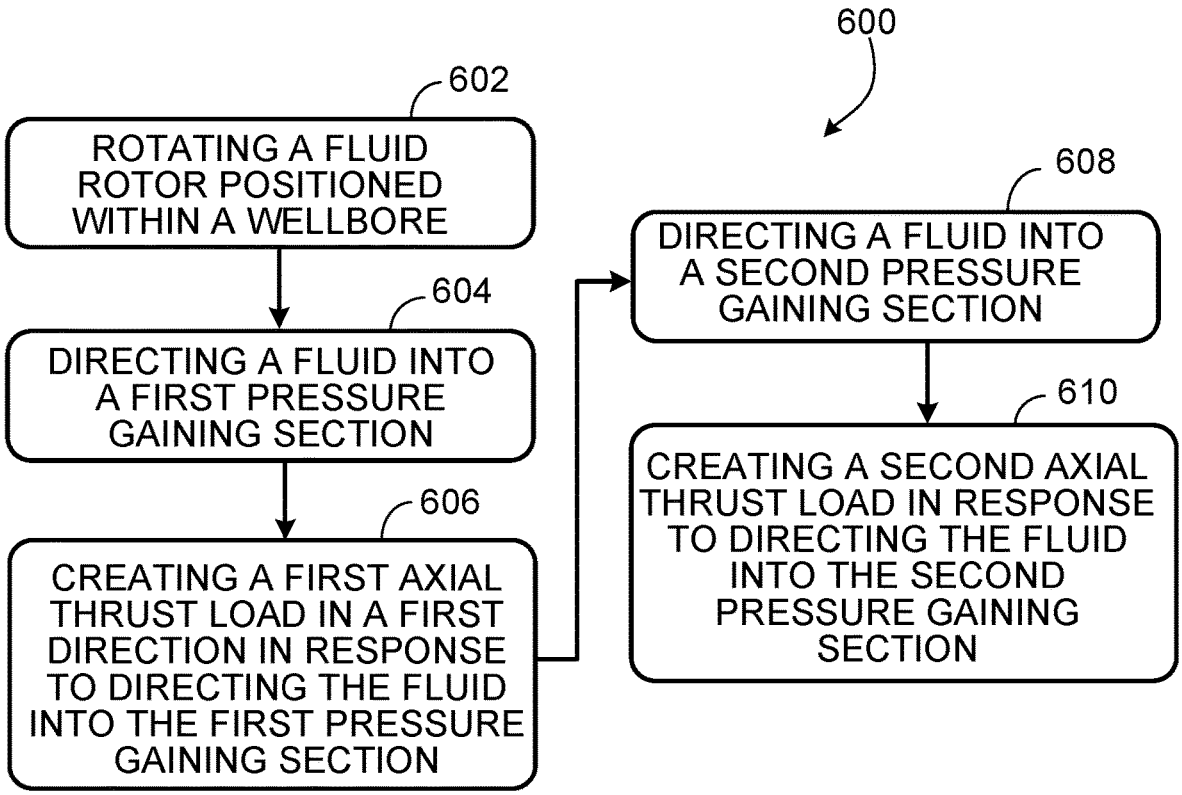
FIG. 6 is a flowchart of an example thrust balancing method using back-to-back configurations that can be used with aspects of this disclosure.

FIG. 6 shows a flowchart of an example thrust balancing method 600 using back-to-back ESP (400 and 450) configurations. Details of the method 600 are described in the context of FIGS. 1, 4A-4B, and 5A-5B. At 602, upon starting an ESP system 101 positioned within a wellbore 106, an ESP motor 230 rotates a first fluid rotor 404 of an ESP 400 or 450. The ESP 400 or 450 has a first fluid stage 413 and a second fluid stage 414. In some implementations, a magnetic coupling 220 is used to transfer the rotary motion from the ESP motor 230 to the first fluid rotor 404 in order to rotate the ESP 400 or 450. In some implementations, the first fluid rotor 404 is axially supported by a thrust bearing 415 positioned within a housing 408 or 409. The housing 408 or 409 surrounds the first fluid stage 413, the second fluid stage 414, and a flow crossover sub 500A or 500B.

At 604, a flow crossover sub 500A or 500B directs a fluid 105 into an intake end 413A of the first fluid stage 413. The first fluid stage 413 pressurizes the fluid 105 in response to the rotary motion transferred to the first fluid rotor 404. The first fluid rotor 404 converts the rotary motion transferred from the ESP motor 230 into rotational energy applied to the fluid 105. The first fluid stage 413 includes a first fluid stator 406. The first fluid stator 406 converts the rotational energy of the fluid 105 into pressure head. The pressurized fluid 105 is displaced through a discharge end 413B of the first fluid stage 413. In some implementations, the fluid 105 is a wellbore production fluid. The wellbore production fluid can include of oil, gas, water, or a combination of some or all.

At 606, a first axial thrust is created in response to discharging the pressurized fluid 105 from the first fluid stage 413. The first axial thrust acts in a first direction. In some implementations, the first direction is upwards (towards the tubular 102) because the discharge 413B is at a downhole end of the first fluid stage 413. In some implementations, the first direction is downwards (towards the coupling 220) because the discharge 413B is at an uphole end of the first fluid stage 413.

At 608, the flow crossover sub 500A or 500B directs a fluid 105 into an intake end 414A of the second fluid stage 414. The second fluid stage 414 pressurizes the fluid 105 in response to the rotary motion transferred to a second fluid rotor 405. The second fluid rotor 405 is rotatably coupled to the first fluid rotor 404 to rotate in unison with the first fluid rotor 404. The second fluid stage 414 includes a second fluid stator 407. The second fluid stator 407 converts the rotational energy applied to the fluid 105, by the second fluid rotor 405, into pressure head. The pressurized fluid 105 is displaced through a discharge end 414B of the second fluid stage 414. In some implementations, the crossover sub 500B directs the fluid 105 into the second fluid stage 414 after the fluid 105 is directed into the first fluid stage 413. In some implementations, the crossover sub 500A directs the fluid 105 into the second fluid stage 414 and the first fluid stage 413, simultaneously.

At 610, a second axial thrust load is created in response to discharging the pressurized fluid 105 from the second fluid stage 414. The second axial thrust acts in a second direction. The second direction of the second axial thrust is opposite to the first direction of the first axial thrust. In some implementations, the second direction is upwards (towards the tubular 102) because the discharge 414B is at a downhole end of the second fluid stage 414. In some implementations, the second direction is downwards (towards the coupling 220) because the discharge 414B is at an uphole end of the second fluid stage 414.

In some implementations, the first fluid stage 413 discharges pressure that is equivalent to the pressure discharged by the second fluid stage 414. Consequently, the second axial thrust load is opposite in direction and equal in magnitude to the first axial thrust load. Therefore, the first axial thrust created by the first fluid stage 413 cancels out the second axial thrust created by the second fluid stage 414. A third axial thrust is created by a weight of the first fluid rotor 404. A fourth axial thrust is created by a weight of the second fluid rotor 405. In some implementations, the thrust bearing 415 is sized based on a net axial thrust load of the ESP 400 or 450 during operation. The net axial thrust load includes a sum of the first axial thrust, the second axial thrust, the third axial thrust, and the fourth axial thrust. In some implementations, the thrust bearing 415 is sized based on a net axial thrust load of the third axial thrust and the fourth axial thrust because the first axial thrust is countered by the second axial thrust.

While this disclosure contains many specific implementation details, these should not be construed as limitations on the scope of any inventions or of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A downhole-type pump comprising:

a housing defining a pump intake and a pump discharge;

a fluid rotor positioned within the housing between the pump intake and the pump discharge, the fluid rotor having a fluid rotor intake end and a fluid rotor discharge end;

a fluid stator surrounding the fluid rotor and positioned within the housing between the pump intake and the pump discharge, the fluid stator having a fluid stator intake end and a fluid stator discharge ends;

a shaft passing through a rotational axis of the fluid rotor, the shaft attached to the fluid rotor to rotate in union with the fluid rotor, the shaft defining a central fluid passage extending from the pump intake to the pump discharge, the shaft configured to direct a portion of a pressurized fluid pumped through the pump discharge to an opening defined by the pump downhole of the pump intake; and a balance piston surrounding the shaft, the balance piston attached to and extending from an outer surface of the shaft to an inner surface of the housing, the balance piston positioned between the opening and the pump intake.

2. The downhole-type pump of claim 1, wherein the balance piston comprises dynamic seals around an outer circumference of the balance piston positioned between the balance piston and the housing.

3. The downhole-type pump of claim 1, wherein the balance piston is attached to the shaft to rotate in unison with the shaft.

4. The downhole-type pump of claim 1, wherein the fluid rotor and the fluid stator are a centrifugal fluid rotor and centrifugal fluid diffuser.

5. The downhole-type pump of claim 1, further comprising a portion of a magnetic coupling positioned at the intake end of the rotor.

6. The downhole-type pump of claim 1, further comprising a thrust bearing axially supporting the fluid rotor within the stator, the thrust bearing being housed within the housing.

7. The downhole-type pump of claim 6, wherein the thrust bearing is sized based on a net axial thrust load of the fluid rotor during operation, the net axial thrust load comprising a sum of a first thrust created by displacing a fluid, a second thrust created by a portion of the displace fluid pressurizing the balance piston, and a third thrust created by a weight of the fluid rotor.

8. A system comprising:

a downhole-type pump comprising:

a housing defining a pump intake and a pump discharge;

a fluid rotor positioned within the housing between the pump intake and the pump discharge;

a fluid stator surrounding the fluid rotor and positioned within the housing between the pump intake and the pump housing, the fluid rotor and the fluid stator configured to cooperatively flow fluid from a downhole end to an uphole end of a wellbore in which the downhole-type pump is configured to be disposed;

a shaft passing through the center of the fluid rotor, the fluid stator and the housing, the shaft attached to rotate in union with the fluid rotor, the shaft extending from the pump intake to the pump discharge, the shaft defining:

a central fluid passage extending from the pump intake to the pump discharge, and an opening downhole of the pump intake and connected to the central fluid passage, the central fluid passage to flow a portion of the fluid pumped through the pump discharge to the opening; and a balance piston surrounding the shaft, the balance piston extending from an outer surface of the shaft to an inner surface of the housing, the balance positioned between the opening and the pump intake;

production string fluidically connecting the pump discharge to a topside facility; and a motor rotatably coupled to the fluid rotor, the motor connected to the fluid rotor by a coupling.

9. The system of claim 8, wherein the motor is positioned downhole of the pump.

10. The system of claim 8, wherein the coupling comprises a magnetic coupling.

11. The system of claim 10, wherein the motor comprises a first thrust bearing and the pump comprises a second thrust bearing that is separate from the first thrust bearing.

12. The system of claim 8, wherein the balance piston comprises dynamic seals around an outer circumference of the balance piston positioned between the balance piston and the housing.

13. The system of claim 8, wherein the balance piston is attached to the shaft to rotate in unison with the shaft.

14. The system of claim 8, wherein the fluid rotor and the fluid stator are a centrifugal fluid rotor and centrifugal fluid diffuser.

* * * * *